US006400339B1

(12) United States Patent
Edvardsson et al.

(10) Patent No.: US 6,400,339 B1
(45) Date of Patent: Jun. 4, 2002

(54) ANTENNA DEVICE COMPRISING CAPACITIVELY COUPLED RADIATING ELEMENTS AND A HAND-HELD RADIO COMMUNICATION DEVICE FOR SUCH ANTENNA DEVICE

(75) Inventors: Olov Edvardsson, Taby; Richard Bohannan, Langas, both of (SE); Thierry Bousquet, Clamart (FR); Gianni Barone, Roma (IT)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/312,503

(22) Filed: May 17, 1999

(30) Foreign Application Priority Data

May 18, 1998 (SE) ..... 9801755

(51) Int. Cl.[7] ..... H01Q 1/36
(52) U.S. Cl. ..... 343/895; 343/702
(58) Field of Search ..... 343/895, 702, 343/700 MS, 853, 796, 850; H01Q 1/36

(56) References Cited

U.S. PATENT DOCUMENTS

| | | | | | |
|---|---|---|---|---|---|
| 4,148,030 | A | * | 4/1979 | Foldes | 343/895 |
| 5,134,422 | A | | 7/1992 | Auriol | 343/895 |
| 5,198,831 | A | | 3/1993 | Burrell et al. | 343/895 |
| 5,572,224 | A | | 11/1996 | Moller et al. | 343/702 |
| 5,594,461 | A | * | 1/1997 | O'Neill, Jr. | 343/895 |
| 5,628,057 | A | | 5/1997 | Phillips et al. | 455/89 |
| 5,650,792 | A | * | 7/1997 | Moore et al. | 343/725 |
| 5,678,201 | A | * | 10/1997 | Thill | 455/89 |
| 5,708,445 | A | | 1/1998 | Moller et al. | 343/702 |
| 5,910,790 | A | * | 6/1999 | Ohmuro et al. | 343/895 |
| 5,990,847 | A | * | 11/1999 | Filipovic et al. | 343/895 |
| 6,094,178 | A | * | 7/2000 | Sanford | 343/895 |
| 6,181,295 | B1 | * | 1/2001 | Sharaiha et al. | 343/895 |
| 6,232,929 | B1 | * | 5/2001 | Ermutlu et al. | 343/895 |
| 6,278,414 | B1 | * | 8/2001 | Filipovic | 343/895 |
| 6,339,408 | B1 | * | 1/2002 | Edvardsson et al. | 343/895 |

FOREIGN PATENT DOCUMENTS

| | | |
|---|---|---|
| EP | 0320404 | 6/1989 |
| FR | 2746547 | 9/1997 |
| FR | 2746548 | 9/1997 |
| WO | WO97/11507 | 3/1997 |
| WO | WO97/35356 | 9/1997 |
| WO | WO97/35357 | 9/1997 |

* cited by examiner

*Primary Examiner*—Tho Phan
*Assistant Examiner*—Trinh Vo Dinh
(74) *Attorney, Agent, or Firm*—Jacobson Holman, PLLC

(57) ABSTRACT

The object of the present invention is to achieve an antenna for both receiving and transmitting circularly polarized RF signals which is smaller and lighter than prior art antennas as well as to achieve one antenna for both receiving and transmitting circularly polarized RF signals which has better characteristics for a given physical length than prior art antennas. This is achieved by providing an N-helical-filar antenna with N radiating elements coaxially arranged and defining a cylindrical envelope where each individual radiating element is capacitively coupled to another radiating element.

18 Claims, 11 Drawing Sheets

ANTENNA DEVICE COMPRISING CAPACITIVELY COUPLED RADIATING ELEMENTS AND A HAND-HELD RADIO COMMUNICATION DEVICE FOR SUCH ANTENNA DEVICE

TECHNICAL FIELD OF INVENTION

The present invention relates to an antenna device comprising capacitively coupled radiating elements and a hand-held mobile communication device comprising such an antenna in general, and more specifically to an antenna device and a hand-held mobile communication device comprising such an antenna for receiving and transmitting circularly polarized RF signals for communication with satellites.

DESCRIPTION OF RELATED ART

One of the driving forces of the mobile communication industry today is availability and another is size. A user of a hand-held mobile communication device requires to be reached wherever his location may be. This puts requirements on the operator to have good coverage of their mobile network, but for large unpopulated areas this is not possible with any reasonable economy. One solution for a user who frequently travels to unpopulated locations is to instead use a satellite telephone.

Such a user will still have requirements on the size of his satellite communication device as he undoubtedly will compare his ordinary cellular communication device with his satellite communication device. Since the distance to orbiting satellites is so great the antennas used will be larger compared to antennas for cellular communication devices, and will consequently take a considerable amount of the space of a satellite communication device. The need for reducing the size of the antennas for satellite communication devices is thus large and anyone being able to reduce the size for such an antenna will have a considerable competitive advantage.

In U.S. Pat. No. 5,191,352 is a quadrifilar radio frequency antenna disclosed for receiving signals from an earth orbiting satellite. The antenna has four helical wire elements shaped and arranged so as to define a cylindrical envelope. The elements are co-extensive in the axial direction of the envelope.

WO 96/06468 discloses an antenna device with a ceramic core with a relative dielectric constant of at least 5 where every second helical element is longer so that a self-phased antenna is achieved. Every second element is made longer through a meandering shape.

In the journal Microwave Engineering Europe June/July 1995 an antenna for personal hand-held terminals is disclosed. The antenna is of quadrifilar helix type.

RELATED PATENT APPLICATIONS

The following patent applications are related to the same technical field as the invention of this application, and are hereby incorporated herein by reference:

- the Swedish patent application SE 9801754-4 having the title "An antenna system and a radio communication device including an antenna system", filed in Sweden the same day as this application, May 18, 1998, applicant Allgon AB,
- the Swedish patent application SE 9801753-6 having the title "Antenna device comprising feeding means and a hand held radio communication device for such antenna device", filed in Sweden the same day as this application, May 18, 1998, applicant Allgon AB, and
- the Swedish patent application SE 9704938-1, filed Dec. 30, 1997, applicant Allgon AB, having the title "Antenna system for circularly polarised radio waves including antenna means and interface network."

SUMMARY OF INVENTION

The main object of the present invention is thus to achieve an antenna for both receiving and transmitting circularly polarized RF signals, which is smaller and lighter than prior art antennas.

Another object of the present invention is to achieve one antenna for both receiving and transmitting circularly polarized RF signals which has better characteristics for a given physical length than prior art antennas.

Another object according to one embodiment of the present invention is to achieve an antenna, which can receive and transmit RF signals in two different frequency bands.

Another object according to one embodiment of the invention is to achieve one antenna for both receiving and transmitting circularly polarized RF signals within a communication system where the RF band for receiving signals and the RF band for transmitting signals is spaced apart.

The problems described above, with how to achieve a smaller and more efficient antenna for receiving and transmitting circularly polarized RF signals is solved by providing an N-helical-filar antenna with N radiating elements, where N is an integer greater than one, coaxially arranged and defining a cylindrical envelope where each individual radiating element is capacitively coupled to another radiating element.

The problems described above, with how to achieve a smaller and more efficient antenna for receiving and transmitting circularly polarized RF signals, according to one embodiment of the invention, is solved by providing an N-helical-filar antenna with N radiating elements coaxially arranged and defining a cylindrical envelope where each individual radiating element has a meandering shape superimposed on the main helical form.

In more detail the objects of the present invention, with how to achieve a smaller and more efficient antenna for receiving and transmitting circularly polarized RF signals are obtained, according to one embodiment of the invention, by providing an N-helical-filar antenna with N radiating elements coaxially arranged and defining a cylindrical envelope where each individual radiating element has a meandering shape overlaid on the main helical form and where each individual radiating element is capacitivly coupled to its neighbor in at least one end distal from the feeding point.

An advantage with the present invention is that a smaller antenna can be achieved for receiving and transmitting circularly polarized RF signals.

Another advantage with the present invention is that one antenna can be used for receiving and transmitting circularly polarized RF signals in more than one band.

Another advantage with the present invention is that only one antenna is needed both for receiving and transmitting circularly polarized RF signals even when the band for receiving RF signals is widely separated from the band for transmitting RF signals.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying drawings, which are given by way of illustration only and thus, are not limitative of the present invention and wherein.

DETAILED DESCRIPTION OF PREFERRED EMBODIMENTS

Figure 1:
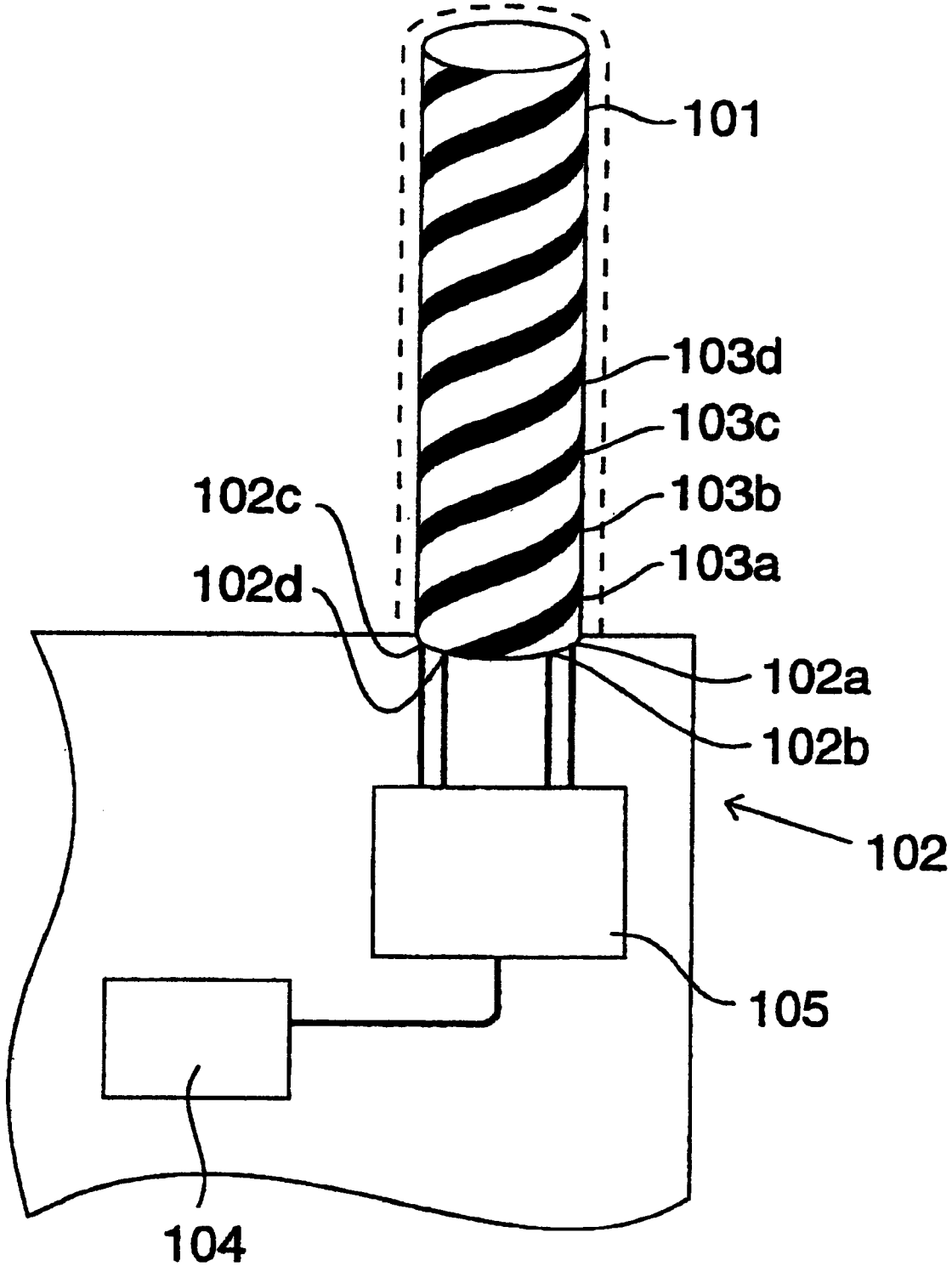
FIG. 1 shows a prior art antenna.

FIG. 1 shows a prior art antenna. With 101 is a support denoted and with 102 is a feeding means denoted. The feeding means 102 comprises a first, second, third and fourth feeding points 102*a*, 102*b*, 102*c*, and 102*d*. Said feeding points are connected to a first, second, third and fourth radiating elements denoted 103*a*, 103*b*, 103*c* and 103*d*, commonly denoted 103. The radiating elements are coaxially wounded around a common axis defining a helical structure. RF signals are fed to the radiating elements 103 from a circuitry 104 through a phasing network 105. The phasing network 105 converts the RF signal to four signals, each fed to one feed point respectively, with a phase difference of 360°/4=90° enabling the antenna to produce circularly polarized RF signals. The signals may be right-hand or left-hand polarized. The different polarization is achieved by winding the radiating elements in a right-hand or a left-hand direction and by feeding the RF signals accordingly.

Even though, throughout this description, mostly transmission of RF signals is described, the antenna device is of course also capable of receiving signals.

Figure 2:
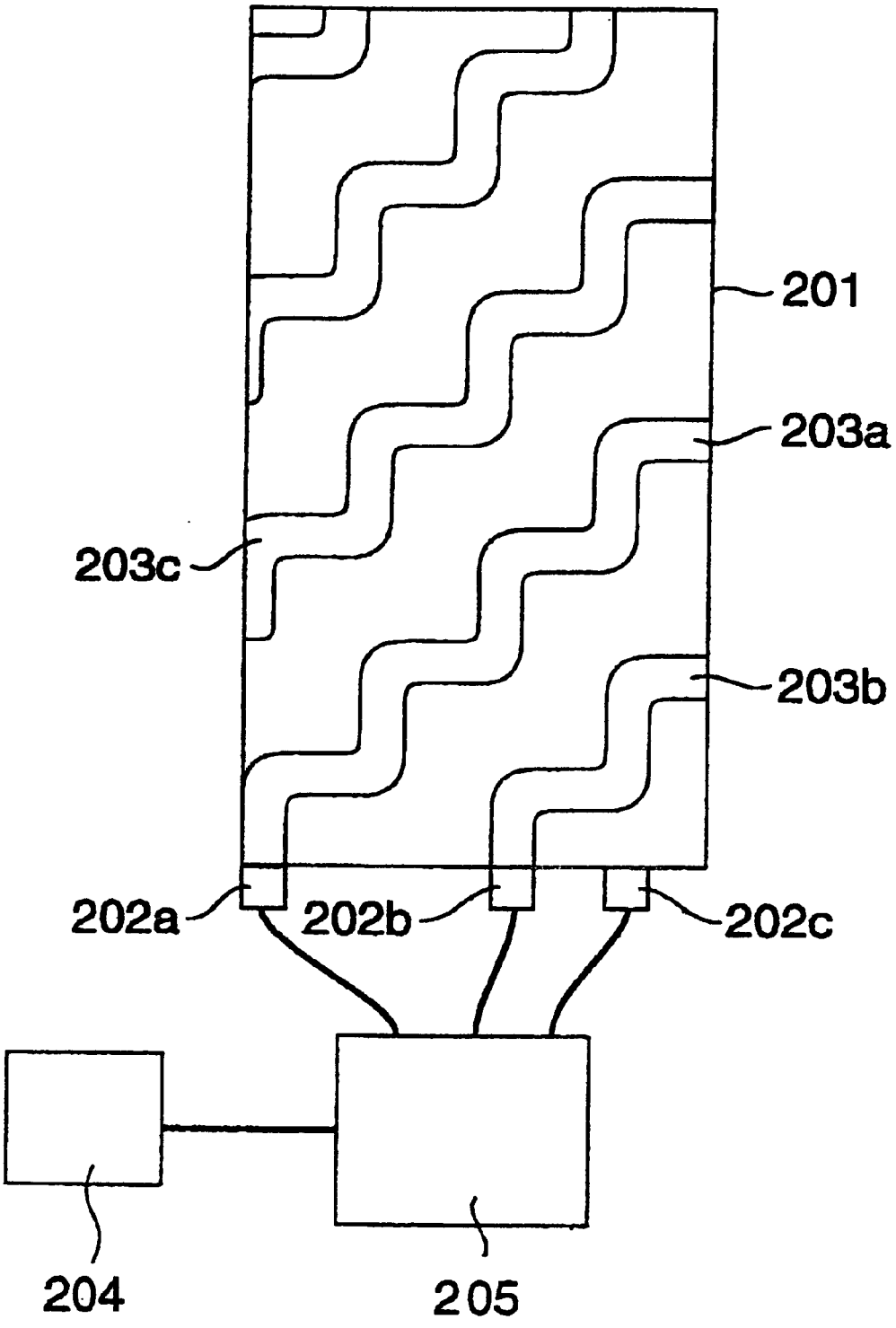
FIG. 2 shows a meandering radiating pattern antenna according to a first preferred embodiment of the invention.

FIG. 2 shows an antenna according to a first preferred embodiment of the invention. With 201 is a support denoted and a first, second and third feeding points is denoted 202*a*, 202*b* and 202*c* respectively. Said feeding points are coupled to a first, second and third radiating elements 203*a*, 203*b* and 203*c* respectively, said radiating elements are commonly denoted 203. Said radiating elements 203 are in this preferred embodiment molded directly onto said support using MID (Molded Intrusion Design) technology. Said radiating elements 203 are arranged so as to form a cylindrical envelope on said support. That is, each radiating element is wounded round a common axis, defined by said support, coextending in a cylindrical manner so as to define an helical form with a common radius and pitch. A meandering pattern is superimposed on said helical form construing a common helical form with meandering pattern. In other words, each of said radiating elements 203*a*, 203*b*, 203*c* comprises a number of small bends or turns without complete turns so as to define a stair-like pattern on said support. The meandering pattern increases the electrical length of the radiating element for the same physical length and capacitively couples each radiating element to its neighbors, thereby enabling the design of a shorter antenna with a given electrical length for a specific application such as for instance Iridium, Globalstar etc. A circuitry 204 feeds RF signals to said feeding points 202 through a phasing network 205. Said phasing network 205 converts the RF signal to three different signals with a phase difference of 360°/3=120° and feeds said signals to each of said feeding points 202 respectively enabling the production of circularly polarized RF signals. The signals may be right-hand or left-hand polarized. The different polarization is achieved by winding the radiating elements in a right-hand or a left-hand direction and by feeding the RF signals accordingly. The meandering shape of the radiating elements may be arranged so that capacitive coupling occur between the different radiating elements.

Figure 3:
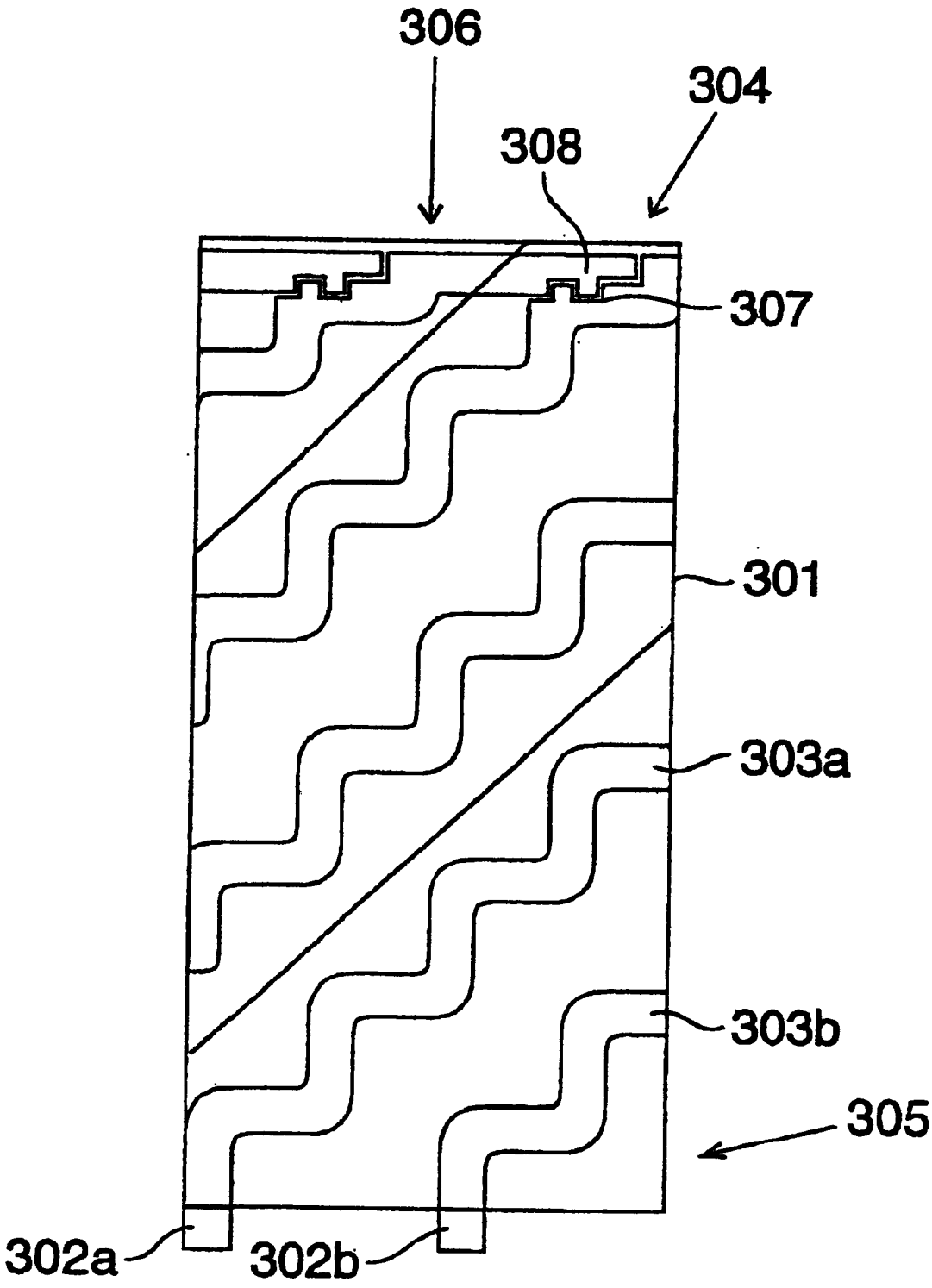
FIG. 3 shows a meandering radiating pattern antenna with top capacitance according to a second preferred embodiment of the invention.

FIG. 3 shows a second preferred embodiment according to the invention. A support is denoted 301 and a first and second feeding points, in a first end 305 of said support 301, are denoted 302*a* and 302*b* respectively. A first and second radiating element is denoted 303*a* and 303*b* respectively commonly denoted 303. Said radiating patterns 303 are arranged so as to form a helical cylindrical envelope on said support with an overlaid meandering pattern. That is each radiating element is wounded around a common axis, defined by said support, in a cylindrical manner so as to define a helical pattern. In other words, each of said radiating elements 303 comprises a number of small bends or turns back-and-forth without complete turns so as to define a stair-like pattern on said support. The radiating patterns are printed, etched or similar on a thin dielectric carrier. Said carrier is fixedly mounted on said support, for instance with an adhesive agent. Each radiating element 303 further comprises a coupling portion 304 for capacitively couple said first radiating element 303*a* to said second radiating element 303*b* in a second end 306 distal to said first end 305. Said coupling portion 304 comprises a receiving member 307 and a extending member 308 where said extending member 308 fits into said receiving member 307 so as to construe a capacitance. The top capacitance enables the design of even shorter antennas for a given electrical length, it also improves the overall efficiency of the antenna.

Figure 4:
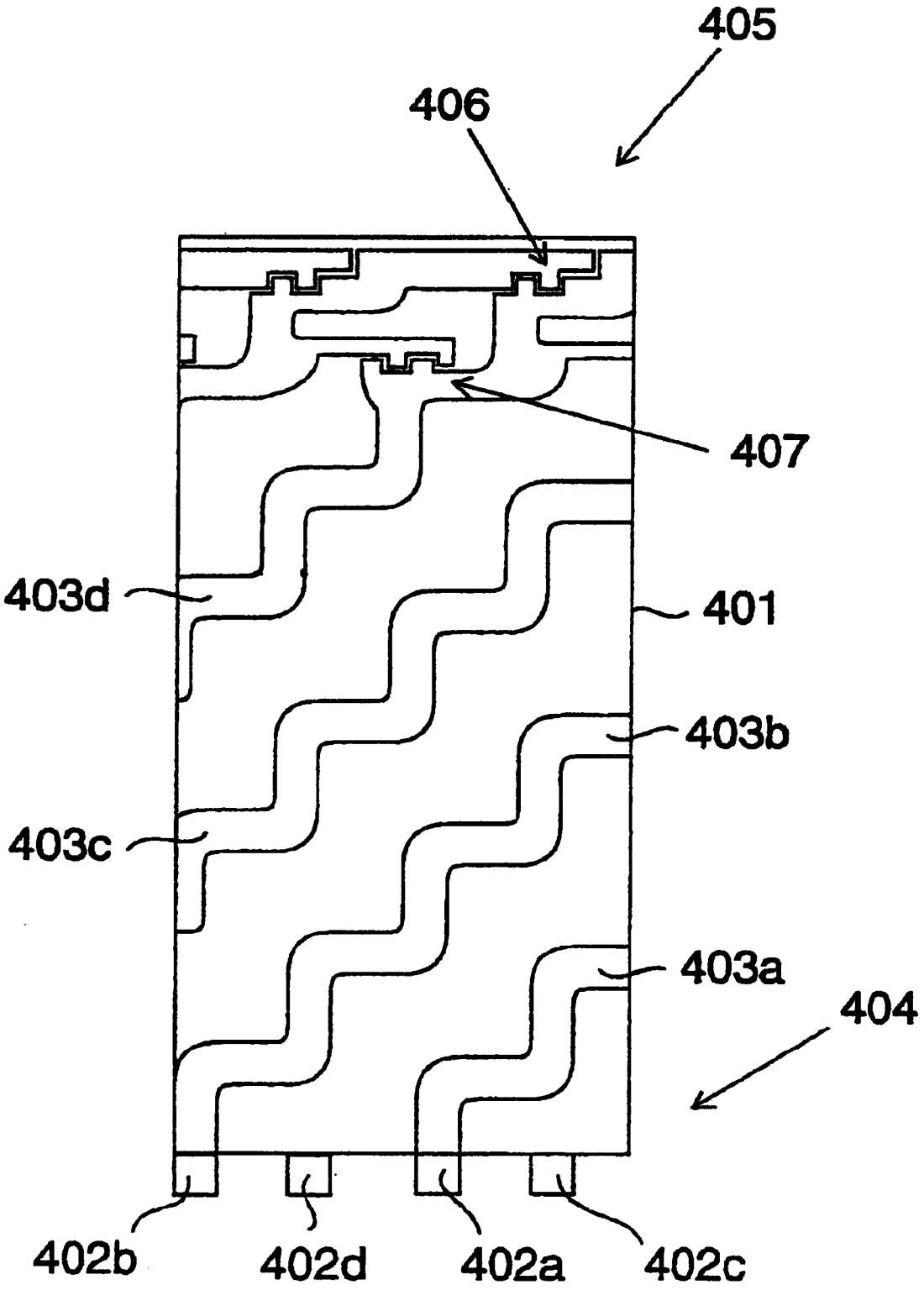
FIG. 4 shows a meandering radiating pattern antenna with top capacitance and a second line of capacitance according to a third embodiment of the invention.

FIG. 4 shows a third preferred embodiment according to the invention. With 401 is a support denoted, first, second, third and fourth feeding points are denoted 402*a*, 402*b*, 402*c* and 402*d* respectively and first, second, third and fourth radiating elements are denoted 403*a*, 403*b*, 403*c* and 403*d* respectively. A first end comprising the feeding points 402 is denoted 404 and a second end distal to said first end is denoted 405. A first coupling portion is denoted 406 and a second coupling portion is denoted 407 said coupling portions 406 and 407 comprise receiving members and extending members similar to the receiving and extending members described in accordance with the second preferred embodiment and FIG. 3. The antenna in FIG. 4 is arranged for receiving and/or transmitting RF signals in two different separate bands. The first coupling portion 406 construing a capacitive coupling between a first radiating 403*a* element and its neighbors, that is the first radiating elements neighbors is the second and fourth elements 403*b* and 403*d*, is effectively lengthening the electrical length of said antenna, adjusted to a first band for receiving and/or transmitting RF signals, compared to the physical length. The second coupling portion 407 is arranged at a distance from said first or second end 404 or 405 so as to adjust said antenna to transmit and/or receive RF signals in a second band with increased efficiency. Said two bands may one be for receiving RF signals and the other for receiving RF signals or both may be for both receiving and transmitting signals. The invention thus make it possible to design a hand-held radio communication device with one single antenna for receiving and/or transmitting RF signals in two separate bands.

Figure 5:
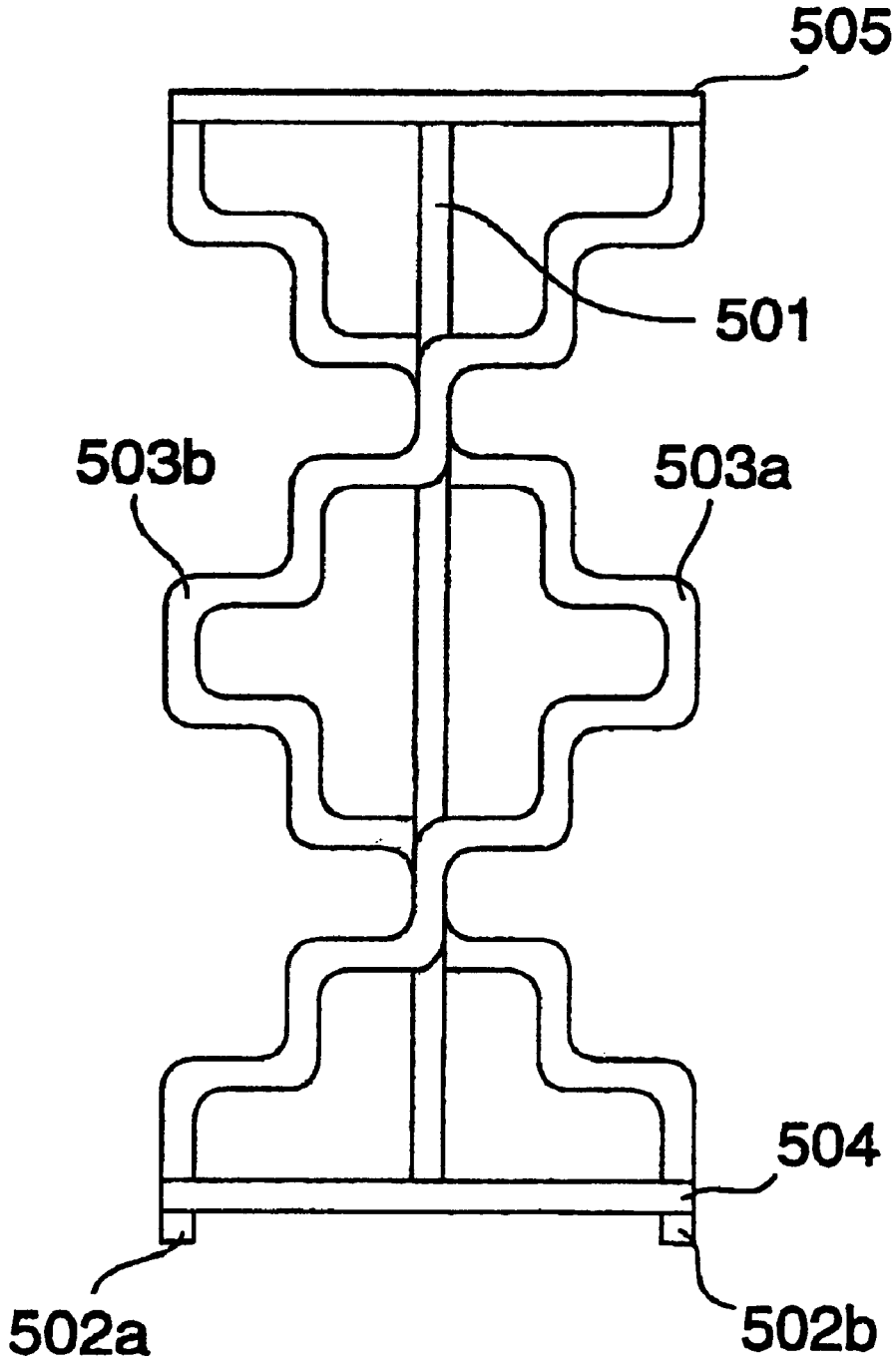
FIG. 5 shows a meandering radiating helical antenna according to a fourth embodiment of the invention.

In FIG. 5, a fourth preferred embodiment according to the invention disclosed. With 501 is a support denoted and with 502*a* and 502*b* is a first and second feeding means denoted. With 503*a* is a first radiating element denoted and with 503*b* is a second radiating element denoted. Said first and second radiating elements are coaxially arranged and shaped so as to form a cylindrical helical envelope, further more each radiating elements comprises small bends or turns back-and-forth without any complete turns so as to define a meandering pattern superimposed on the helical structure. A first disc 504 is arranged in a first end and fixedly mounted to said support 501, said feeding means 502 and said radiating elements 503 enabling coupling between the feeding means 502 and the radiating elements 503. A second disc 505 is arranged on a second end distal to said first end and fixedly mounted to said support 501 and to said first and second radiating elements 503*a* and 503*b*. Said second disc 505 may or may not comprise a capacitive coupling between said radiating elements 503*a* and 503*b*.

Figure 6:
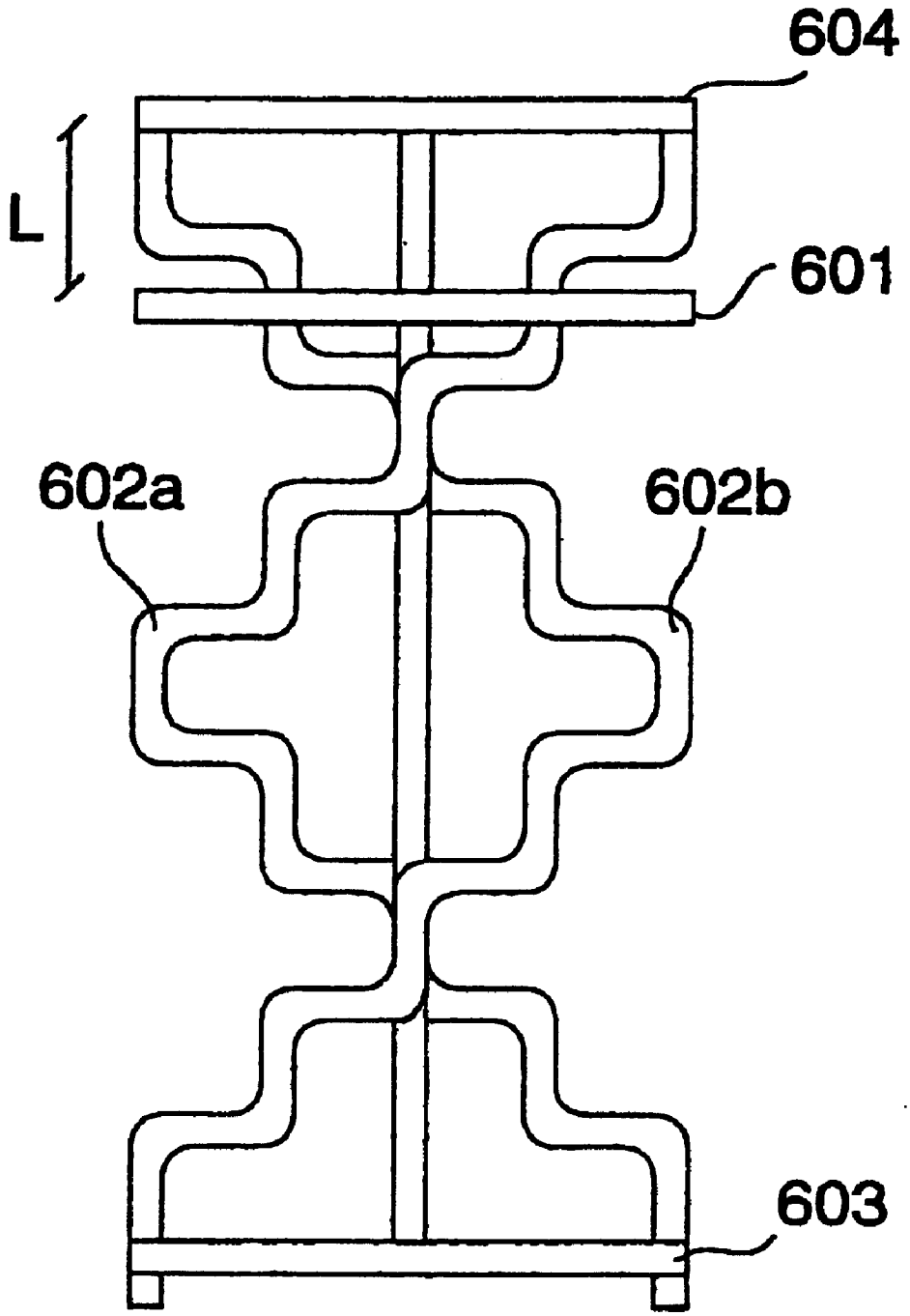
FIG. 6 shows a meandering radiating helical antenna with a disc according to a fifth embodiment of the invention.

In FIG. 6 is a fifth preferred embodiment according to the invention shown. This embodiment is similar to the embodiment just described with the difference of a third disc 601 enabling capacitive coupling between a first and second radiating element 602*a* and 602*b* at a distance L from a first end 604. The distance L is chosen to improve the characteristics of the antenna for a second band for receiving and transmitting RF signals if the total length of the antenna is chosen for optimal performance for a first band for receiving and transmitting RF signals. Of course it might be beneficial to do some trade off in the performance for the first band to improve the characteristics for the second band.

Figure 7A:
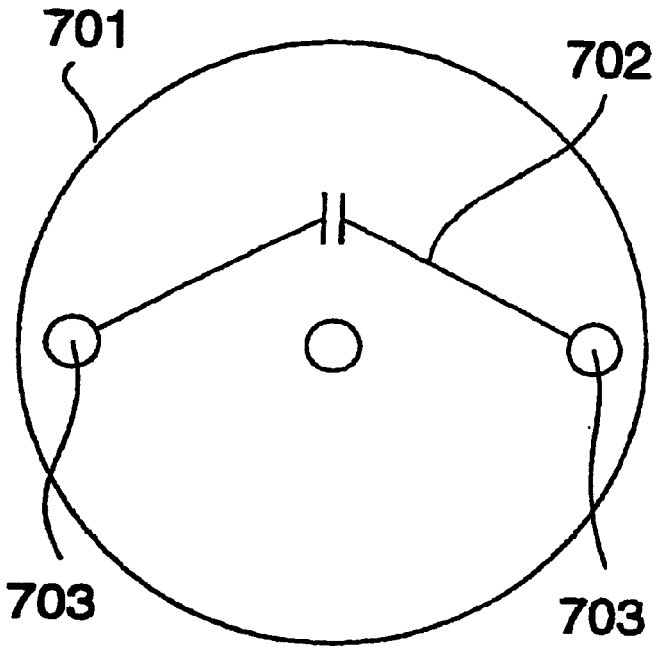
FIG. 7*a*, 7*b* and 7*c* shows a support/capacitance disc disclosed in FIG. 5 and FIG. 6.
Figure 7B:
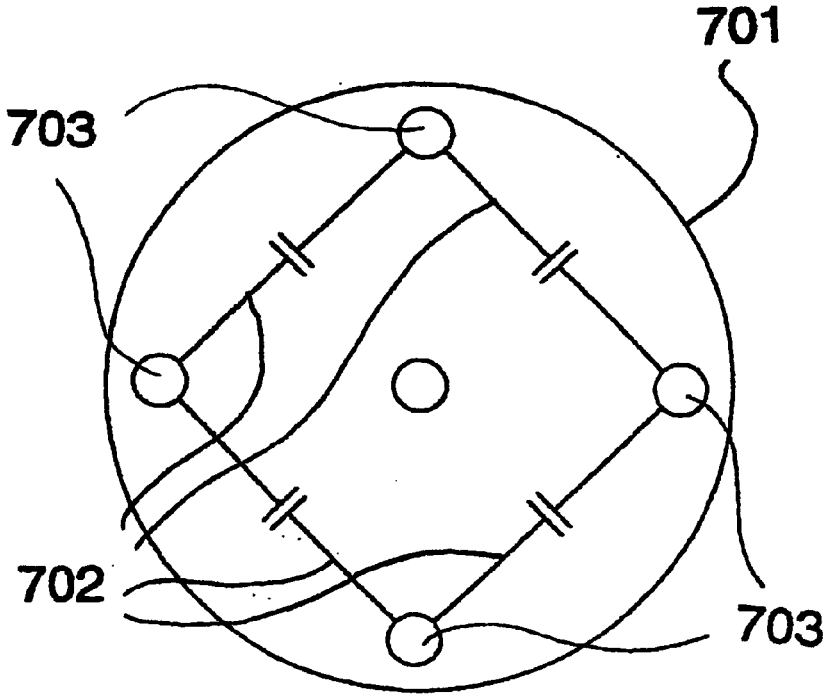
Figure 7C:
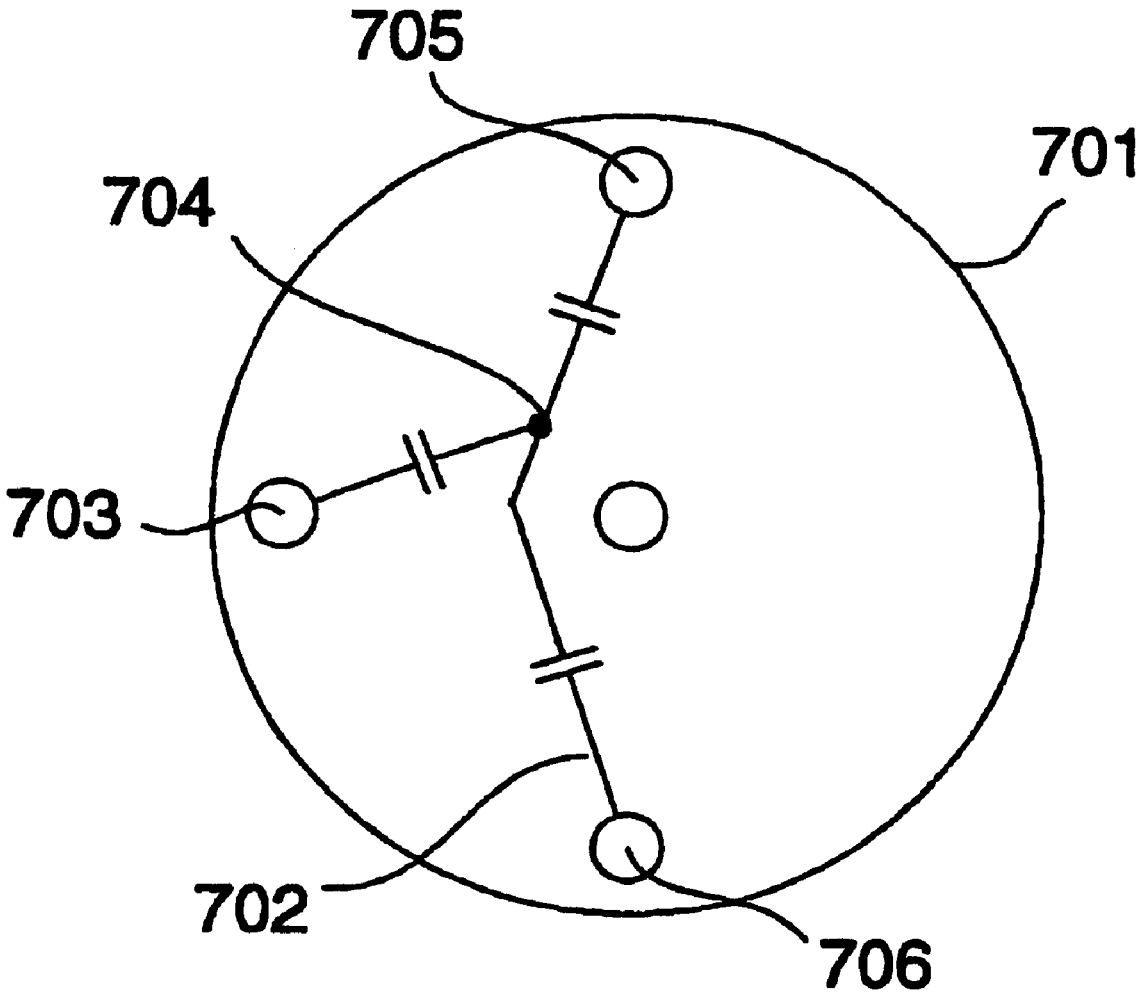

In FIG. 7*a* and 7*b* is discs 701 disclosed with capacitive coupling 702 between the radiating elements 703. FIG. 7*b* also discloses a disc for an antenna with four wires. FIG. 7*c* shows a disc where the capacitors are coupled to a common connection point 704 and also where the antenna elements are not symmetrically arranged but rather with 90° phase difference between a first radiator 703 and a second and third radiator 705 and 706, the second radiator 705 having 90° phase difference to the first radiator 703 and 180° to the third radiator 706 and the third radiator 706 having 90° phase difference to the first radiator 703 and 180° to the second radiator 705.

Figure 8:
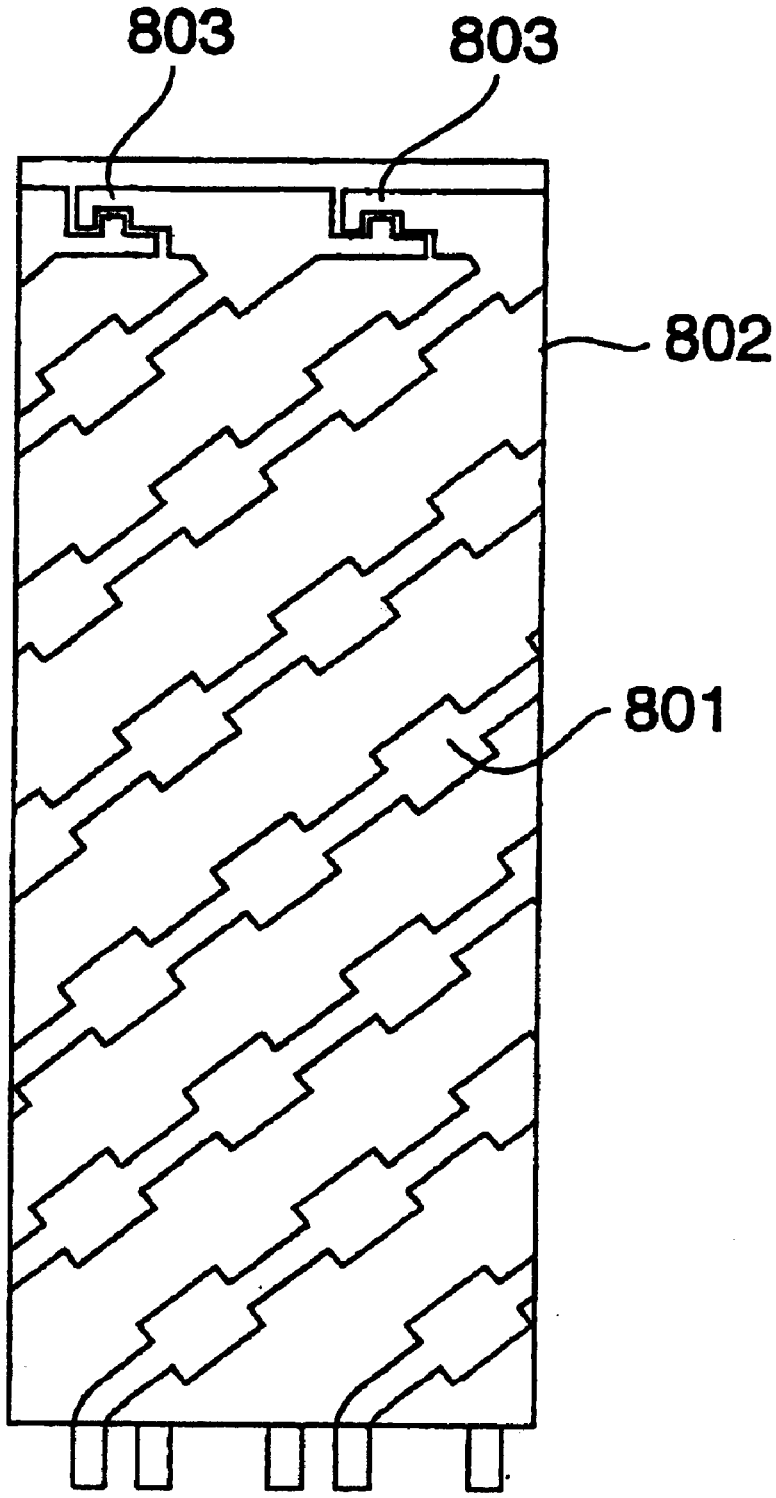
FIG. 8 shows a meandering radiating pattern antenna according to a sixth preferred embodiment of the invention.

FIG. 8 shows a sixth preferred embodiment according to the invention. Five radiating elements 801 are arranged in a helical form construing a cylindrical envelope on a support 802. In this embodiment a different radiating pattern is used with meandering edges. The pattern comprises alternating broader and narrower passages so that the edges of the pattern form a meandering shape. Thus, this type of pattern is also included in term meandering pattern or meander radiating element. Coupling portions 803 at a first end capacitively couples each radiating element to its neighbor, that is the first element is capacitively coupled to the second and fifth element, the second element is capacitively coupled to the third and first element and so on to the fifth element which is capacitively coupled to the fourth and first element.

Figure 9:
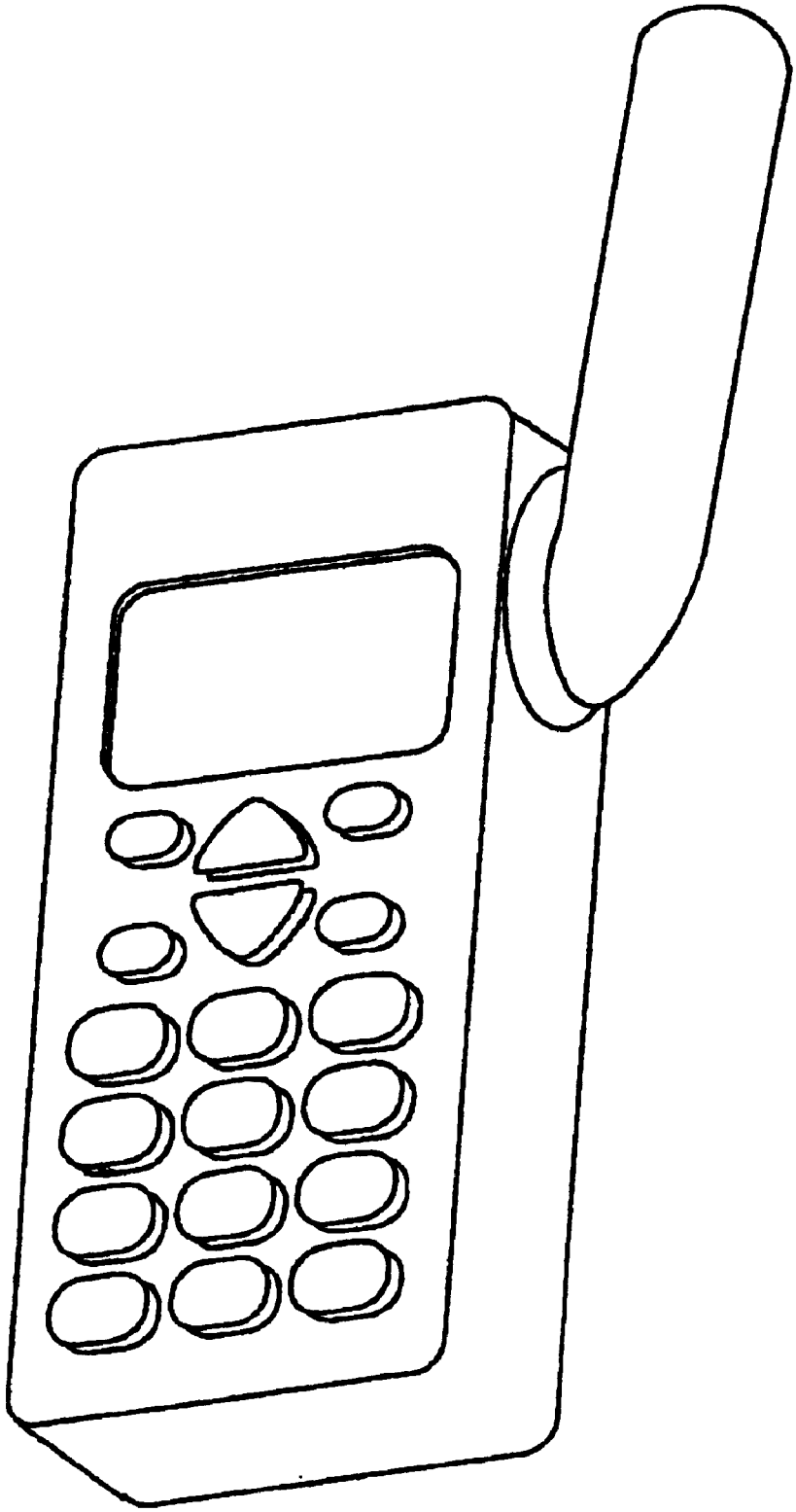
FIG. 9 shows a hand-held communication device with an antenna according to the invention.

FIG. 9 discloses a hand-held radio communication device according to the invention.

Figure 10A:
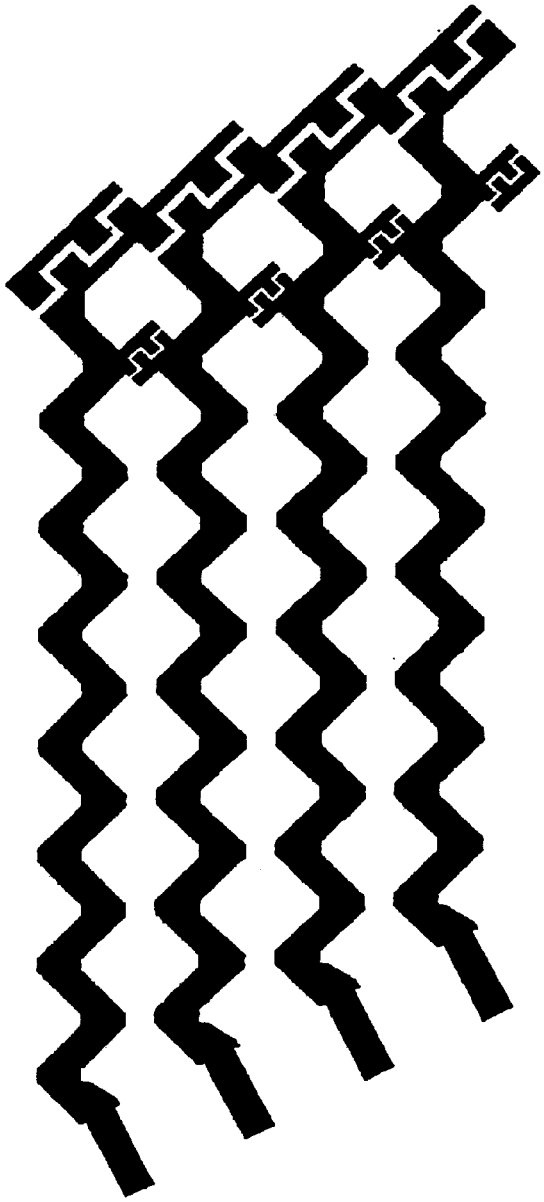
FIG. 10*a* and 10*b* shows different meandering patterns.
Figure 10B:
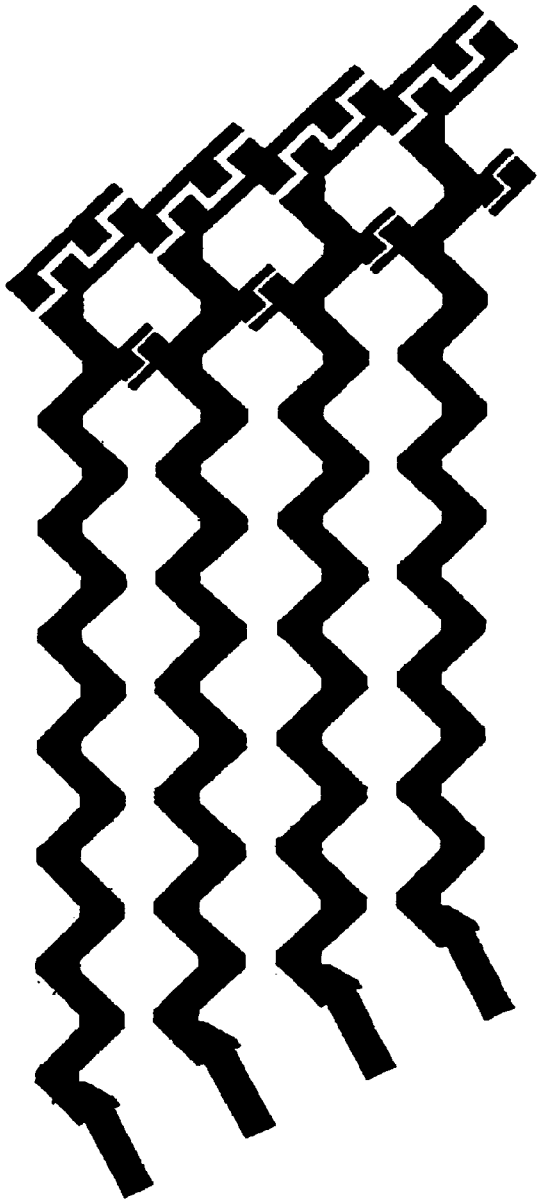

FIG. 10*a* and 10*b* shows different radiating patterns to be applied to a thin flexible carrier and fixedly secured onto a support using for instance a adhesive agent The invention being thus described, it will be obvious that the same may be varied in many ways. For instance is it obvious that the radiating elements may be wounded in either clockwise or counter-clockwise direction even though only one direction is disclosed in the appended drawings. Such variations are not to be regarded as a departure from the spirit and scope of the invention, and all such modifications as would be obvious to one skilled in the art are intended to be included within the scope of the following claims.

What is claimed is:

1. An antenna device for receiving and transmitting RF signals, comprising a support, N radiating elements, N feeding points arranged to feed RF signals to said N radiating elements where N is an integer greater than one, said N feeding points being arranged to be connectable to tranceiving circuitry, said N radiating elements being arranged to transmit RF signals in at least a first frequency band, said circuitry being arranged to feed RF signals to each feed point so that a circularly polarized RF signal is transmitted, each of said N radiating elements being coaxially arranged on said support in a substantially helical form so as to define a cylindrical envelope, at least one coupling means, is arranged to capacitively couple a first of said N radiating elements to at least a second of said N radiating element;

each radiating element is capacitively coupled to both of its closest neighbors through at least one coupling portion;

at least one of said coupling portions is conductively connected to said radiating element, said at least one of said coupling portion comprises at least one receiving member, said at least one of said coupling portion comprises at least one extending member, and said at least one extending member of a first radiating element of said N radiating elements is arranged to fit into said at least one receiving member of a second radiating element of said N radiating elements to achieve a capacitive coupling.

2. The antenna device according to claim 1, wherein said circuitry being arranged to feed RF signals to each feed point with a phase difference of substantially 360°/N so that a circularly polarized RF signal is transmitted.

3. The antenna device according to claim 1, wherein each radiating element of said N radiating elements has a superimposed meandering pattern arranged so that each turn in said meandering pattern constitutes a capacitive coupling to one neighbor of said radiating element.

4. The antenna device according to claim 1, wherein said N feed points are arranged in a first end of said support in a symmetrical circularly manner so that each feed point is an angular distance of substantially 360°/N from its neighbor, and that said N radiating elements are coextending having same radius and pitch.

5. The antenna device according to claim 1, wherein said N feed points are arranged in a first end of said support and said radiating element comprises a first coupling portion located at a second end and a second coupling portion located at a distance L from said second end between said first and second end.

6. The antenna device according to claim 5, wherein said antenna device is arranged to receive and transmit RF signals in a second frequency band, and that the distance L is selected to increase the efficiency of said antenna device in said second frequency band.

7. The antenna device according to claim 1, wherein said N feed points are arranged in a first end of said support and said coupling portion is located at a second end distal from said first end.

8. The antenna device according to claim 1, wherein said N feed points are arranged in a first end of said support and said coupling portion is located at a distance L from a second end between said first and second end.

9. The antenna device according to claim 1, wherein at least two capacitors being arranged so that each capacitor being in a first end connected to a common connection point and in a second end connected to at least one radiating element.

10. An antenna device for receiving and transmitting RF signals, comprising a support, N radiating elements, N feeding points arranged to feed RF signals to said N radiating elements where N is an integer greater than one, said N feeding points being arranged to be connectable to tranceiving circuitry, said N radiating elements being arranged to transmit RF signals in at least a first frequency band, said circuitry being arranged to feed RF signals to each feed point so that a circularly polarized RF signal is transmitted, each of said N radiating elements being coaxially arranged on said support in a substantially helical form so as to define a cylindrical envelope, at least one coupling means, is arranged to capacitively couple a first of said N radiating elements to at least a second of said N radiating element; and said coupling means is a coupling disc arranged to carry at least one capacitor, said disc being securely fixed to said support and arranged to couple said at least one capacitor to at least two of said N radiating elements so as to constitute a capacitive coupling between said at least two radiating elements.

11. The antenna device according to claim 10, wherein said circuitry being arranged to feed RF signals to each feed point with a phase difference of substantially 360°/N so that a circularly polarized RF signal is transmitted.

12. The antenna device according to claim 10, wherein each radiating element of said N radiating elements has a superimposed meandering pattern arranged so that each turn in said meandering pattern constitutes a capacitive coupling to one neighbor of said radiating element.

13. The antenna device according to claim 10, wherein said N feed points are arranged in a first end, of said support in a symmetrical circularly manner so that each feed point is an angular distance of substantially 360°/N from its neighbour, and that said N radiating elements are coextending having same radius and pitch.

14. The antenna according to claim 10, wherein each radiating element is capacitively coupled to both of its closet neighbors through at least one coupling portion.

15. The antenna device according to claim 10, wherein at least two capacitor being arranged so that each capacitor being in a first end connected to a common connection point and in a second end connected to at least one radiating element.

16. A mobile communication device comprising an antenna device for receiving and transmitting RF signals, comprising a support, N radiating elements, N feeding points arranged to feed RF signals to said N radiating elements where N is an integer greater than one, said N feeding points being arranged to be connectable to tranceiving circuitry, said N radiating elements being arranged to transmit RF signals in at least a first frequency band, said circuitry being arranged to feed RF signals to each feed point so that a circularly polarized RF signal is transmitted, each of said N radiating elements being coaxially arranged on said support in a substantially helical form so as to define a cylindrical envelope, at least one coupling means, is arranged to capacitively couple a first of said N radiating elements to at least a second of said N radiating element; and said coupling means is a coupling disc arranged to carry at least one capacitor, said disc being securely fixed to said support and arranged to couple said at least one capacitor to at least two of said N radiating elements so as to constitute a capacitive coupling between said at least two radiating elements.

17. The hand-held mobile communication device according to claim 16, wherein said hand-held device is arranged to receive and/or transmit RF signals to and from an orbiting satellite.

18. The hand-held mobile communication device according to claim 16, wherein said device is arranged to receive and/or transmit RF signals in at least two different separate bands where each band is for receiving and/or transmitting RF signals.

* * * * *